US006231493B1

(12) United States Patent
Kato

(10) Patent No.: US 6,231,493 B1
(45) Date of Patent: May 15, 2001

(54) METHOD AND APPARATUS FOR MAKING A PLEAT IN A SHEET-LIKE MATERIAL

(75) Inventor: Koshimi Kato, Aichi (JP)

(73) Assignee: Nakanihon-Juki Co., Ltd., Aichi (JP)

( * ) Notice: Subject to any disclaimer, the term of this patent is extended or adjusted under 35 U.S.C. 154(b) by 0 days.

(21) Appl. No.: 09/418,801

(22) Filed: Oct. 15, 1999

(30) Foreign Application Priority Data

Oct. 15, 1998 (JP) ..... 10-330115

(51) Int. Cl.[7] ..... B31F 1/00; B31F 1/08

(52) U.S. Cl. ..... 493/423; 493/178; 493/351; 493/384; 493/475; 493/937; 493/966

(58) Field of Search ..... 493/441, 966, 493/937, 458, 448, 417, 416, 423, 179, 178, 384, 351, 476, 475, 478, 479

(56) References Cited

U.S. PATENT DOCUMENTS 3,918,573 * 11/1975 Farney ..... 198/165
4,022,457 * 5/1977 Martin et al. ..... 493/423
5,372,570 * 12/1994 Schmidtke et al. ..... 493/399
5,997,459 * 12/1999 Kruger et al. ..... 493/441

FOREIGN PATENT DOCUMENTS

464242 * 10/1968 (CH) ..... B65H/45/22

* cited by examiner

*Primary Examiner*—Peter Vo
*Assistant Examiner*—Hemant M Desai
(74) *Attorney, Agent, or Firm*—Morgan & Finnegan LLP

(57) ABSTRACT

A method of making a pleat in a sheet-like material comprising the steps of feeding a flexible and thin sheet-like material having a flat surface in a direction of an extended line of an imaginary straight line which is perpendicular to its one end and along the surface, left and right parts of the sheet-like material being conveyed at a substantially same speed at both sides of the straight line, the one end of the sheet-like material being of a flat form at a start of the feeding, the left and right parts of the sheet-like material being gradually reduced in distance therebetween and drawn near toward the straight line at the middle portion of the extended line so as to face with each other and diagonally cross the surface, and coming in contact with each other perpendicularly to the surface at the forward portion of the extended line, thereby to form the pleat, conveying the sheet-like material through the middle portion to the forward portion with the left and right parts gradually twisted in a direction of the straight line, and fixing both sides of a base portion of the pleat with each other, and an apparatus for carrying out the method are provided. Because the automatic mechanical apparatus is provided to supply the fabric to the sewing device to form the pleat, avoiding unstable manual operations, the fabric can be supplied symmetrically to make the pleat of a desired width, without problems of drops of seams and lateral deflection of the pleat regardless of various conditions of the fabric and size of the intended pleat, keeping a constant tightness of stitches of the seams, whereby complicated manual works for adjusting the feeding conditions can be avoided.

7 Claims, 6 Drawing Sheets

METHOD AND APPARATUS FOR MAKING A PLEAT IN A SHEET-LIKE MATERIAL

BACKGROUND OF THE INVENTION

1. Field of the Invention

The present invention relates to a method and an apparatus for making a pleat in a sheet-like material.

2. Description of the Related Art

Conventionally, in order to make pleats in a fabric for a curtain, for example, and fix them by a sewing machine, there have been employed such methods as the fabric is manually supplied to a winding tool for two turns, three turns or four turns, or the fabric is sewn while it is folded manually taking measurements of the pleats according to a scale, or in case where narrow pleats are intended, the fabric is supplied manually to a sewing device through various types of guide members arranged in a row, while the fabric is gradually rounded to be folded from the fabric edge which will constitute a pleated part, or in case where the fabric is short, the total length is mechanically folded at a time and then manually supplied to the sewing device.

However, as the fabric is supplied by hand in such conventional methods, the feed to the winding tool will result in lack of symmetry due to uneveness and unsymmetry which occur in holding force for the fabric and also due to differences in coefficient of friction, thickness and flexibility of the fabric. This will cause undesirable changes in width of the finished pleat, drops of seams, lateral deflection of the pleat. Accordingly, such conventional methods may be applied only to the pleat having a fixed narrower width, but not applicable to the pleat having a larger width, or long-sized fabric. Thus, they have required complicated manual adjusting works that a skilled operator must monitor and re-adjust the feeding conditions.

SUMMARY OF THE INVENTION

It is an object of the present invention to overcome the above described problems of the conventional methods concerning folding and supplying the fabric to the sewing device, and to provide an automatic mechanical apparatus by means of which the fabric can be supplied symmetrically to make a pleat of a desired width, without problems of drops of seams and lateral deflection of the pleat regardless of various conditions of the fabric and size of the intended pleat, keeping a constant tightness of stitches of the seams, thus being applicable to making a wide or narrow pleat in a long or short fabric, whereby complicated manual works for adjusting the feeding conditions can be avoided.

According to the present invention, there are provided:

a method for making a pleat in a sheet-like material comprising the steps of:

feeding a flexible and thin sheet-like material having a flat surface in a direction of an extended line of an imaginary straight line which is perpendicular to its one end and along the surface, left and right parts of the sheet-like which is perpendicular to its one end and along the surface, left and right parts of the sheet-like material being conveyed at a substantially same speed at both sides of the straight line, the one end of the sheet-like material being in a flat form at a start of the feeding, the left and right parts of the sheet-like material being gradually reduced in distance therebetween and drawn near toward the straight line at the middle portion of the extended line so as to face with each other and diagonally cross the surface, and coming in contact with each other perpendicularly to the surface at the forward portion of the extended line, thereby to form the pleat, conveying the sheet-like material through the middle portion to the forward portion with the left and right parts gradually twisted in a direction of the straight line, fixing both sides of a base portion of the pleat with each other, both left and right surfaces of the sheet-like material from the start of the feeding until completion of the pleat being guided along and in parallel to the twist in contact with each other, both the left and right surfaces of the sheet-like material at the start of the feeding being resilinetly pressed toward back faces thereof and conveyed independently of the feeding of the sheet-like material but at the same speed, both the left and right back faces of the sheet-like material from the start of the feeding until the completion of the pleat being resilinetly pressed toward both the surfaces and guided along and in parallel to the twist, and making an angle formed by both the left and right parts of the sheet-like material at the start of the feeding with respect to the forward portion of the extended line increase or decrease toward the left and right of the straight line symmetrically or unsymmetrically, and an apparatus for carrying out the method.

DESCRIPTION OF THE PREFERRED EMBODIMENTS

Figure 1:
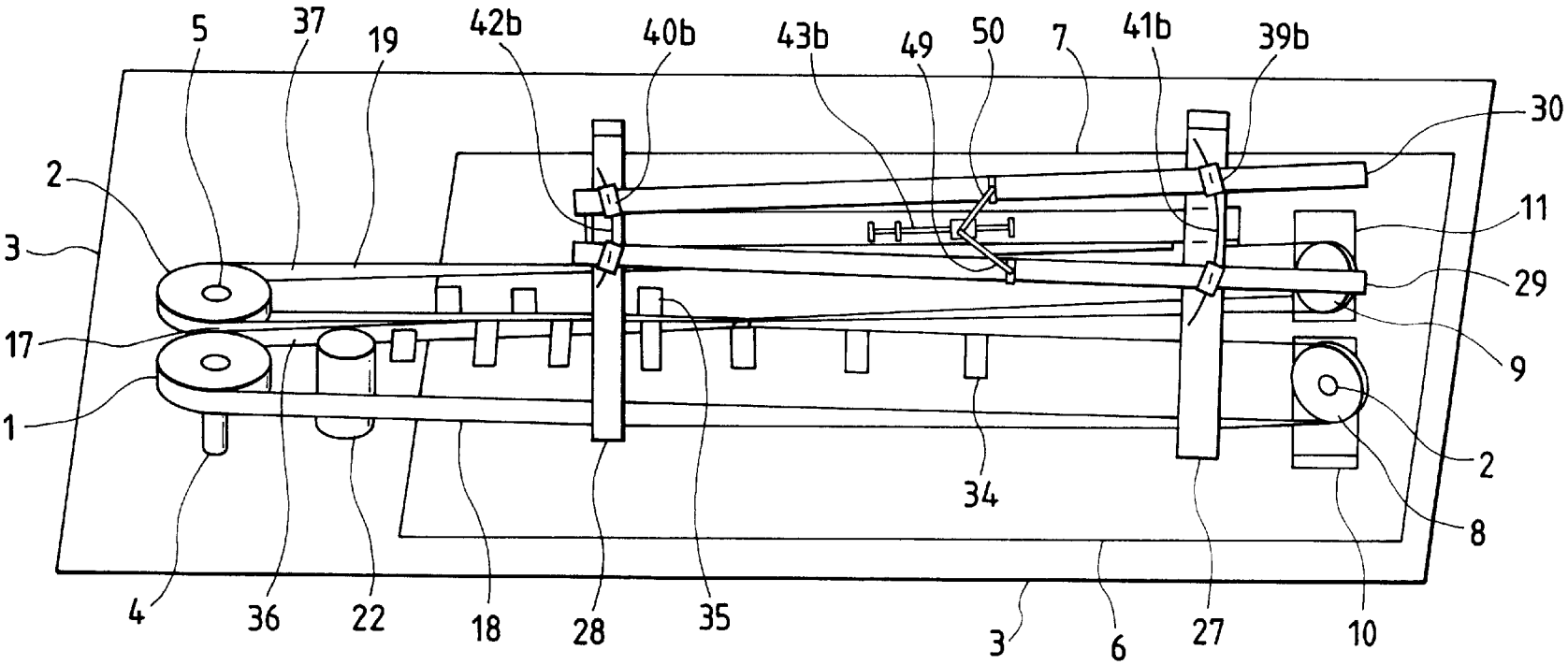
FIG. 1 is a perspective plan view of the entire structure (partly omitted) of an embodiment according to the invention as seen from diagonally above of the left side.

This invention is constructed as follows:

Left and right rear pulleys 1, 2 (FIGS. 1, 3, 5–7) are respectively supported by means of left and right vertical shafts 4,5 which are located apart to the left and the right in parallel to each other and uprightly supported on a main frame 3 which is placed horizontally on a floor. The left and right rear pulleys 1,2 are supported horizontally rotatably in such a manner that their outer peripheries are facing with each other on a same plane and brought closer to each other at one part thereof.

Left and right movable plates 6, 7 (FIGS. 1–3 and 6) are placed on a surface of the main frame 3 and supported so as to be movable to the left and the right along the main frame 3.

Left and right front pulleys 8, 9 (FIGS. 1, 2, 3 and 5) are supported by means of left and right horizontal shafts 12, 13 which are horizontally held by left and right support frames 10, 11 which are located apart from the vertical shafts 4, 5 of the left and right rear pulleys 1,2 in a radial direction and uprightly fixed on the left and right movable plates 6, 7. The left and right front pulleys 8, 9 are vertically rotatably supported in such a manner that their outer faces are separated from each other, and left and right upper parts 15, 16 of their outer peripheries on which a sheet-like material 14 is to be placed and fed are directed toward the vertical shafts 4,5 respectively.

Drive means (not shown) are adapted to control the left and right rear pulleys 1,2 so that they rotate at substantially the same speed in opposite directions wherein both adjacent parts 17 between their outer peripheries move apart from the left and right front pulleys 8, 9, and are adapted to control the left and right front pulleys 8, 9 so that they rotate at substantially the same speed while their upper parts 15, 16 on their outer peripheries move toward the adjacent parts 17 between the left and right rear pulleys 1,2.

Left and right belts 18, 19 (FIGS. 1–3 and 5–7) are respectively wound around a pair of the front and rear pulleys 8, 1 on the left side and another pair of the front and rear pulleys 9, 2 on the right side, in such a manner that respective surfaces 20, 21 of both the belts are gradually twisted at an angle of 90 degree from horizontal to vertical so as to gradually face with each other while moving from the upper parts 15, 16 of the outer peripheries of the front pulleys 8, 9 toward the adjacent parts 17 of the rear pulleys 1,2.

Working member 22 (FIGS. 1, 3, 6 and 7) such as a sewing machine is supported on a main frame 3 directly before the adjacent parts 17 of the outer peripheries of the rear pulleys 1,2, in a belt feeding direction, so as to fix (by sewing, for example) a base portion 24 of a pleat 23 which is formed in a sheet-like material 14 (for example, a fabric) by conveying it by means of the left and right belts 18, 19 and clamping.

Left and right guide members 25, 26 (FIGS. 1, 2, 6 and 7) are in a form of a thin plate and fixed by means of left and right rods 29, 30 which are held laterally movably on front and rear support frames 27, 28 uprightly fixed on a main frame 3, in such a manner that the left and right guide members 25, 26 face with both the surfaces 20, 21 of the left and right belts 18, 19 from middle portion in the belt feeding direction of the upper parts 15, 16 of the outer peripheries of the front pulleys 8,9 to the adjacent parts 17 of the rear pulleys 1, 2 in parallel to the twist of the belts and in a stopped relation with respect to the left and right belts.

Figure 2:
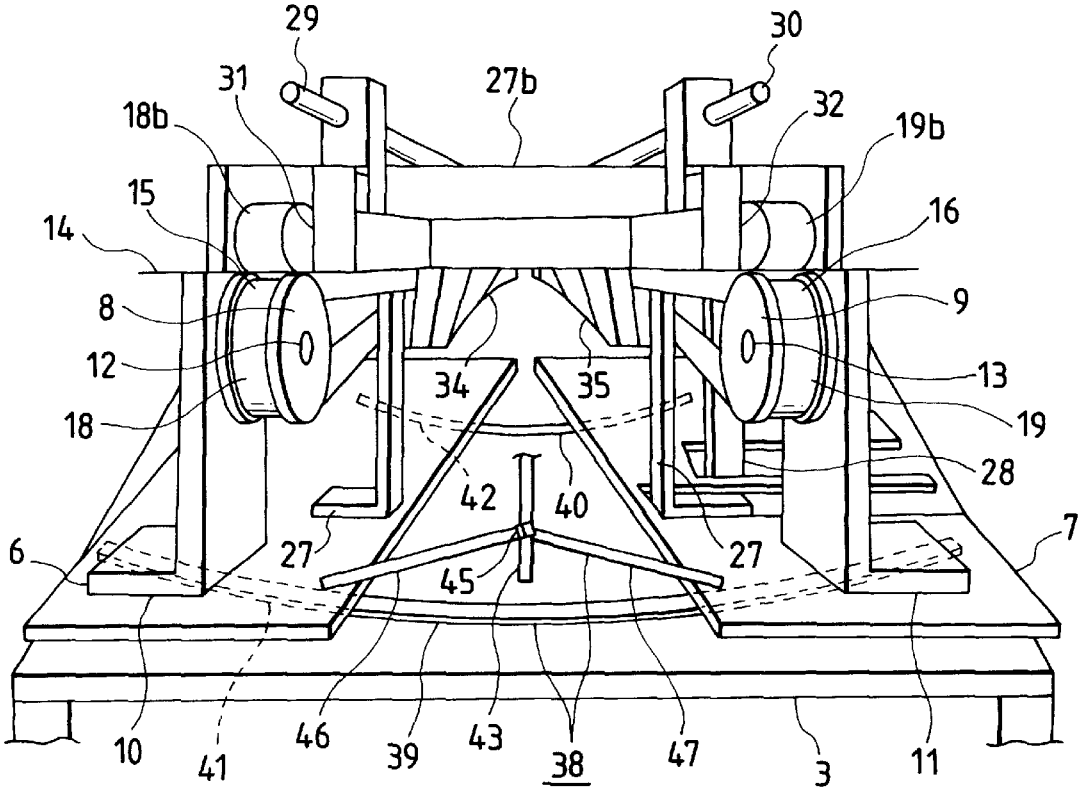
FIG. 2 is a perspective side view of the entire structure (partly omitted) of the embodiment as seen from diagonally above of the front side.

Left and right upper feed members 31, 32 (as shown in FIG. 2) are supported by means of the left and right rods 29, 30 through left and right rollers 8*b*, 9*b* to rotate left and right upper belts 18*b*, 19*b* synchronizing with the left and right belts 18, 19 at the same speed in the same direction so as to feed the sheet-like material 14 supplied on the surfaces of the belts 18, 19 near the upper parts 15, 16 of the outer peripheries of the front pulleys 8,9 while both sides of the sheet-like material 14 are pressed with springs 33 onto the respective surfaces 20, 21 of the left and right belts 18, 19.

A plurality of left and right pressure members 34, 35 (as shown in FIG. 2) are supported by means of the movable plates 6,7 and contact both back faces 36, 37 of the left and right belts 18, 19 from middle portion in the belt feeding direction of the upper parts 15, 16 of the outer peripheries of the front pulleys 8,9 to the adjacent parts 17 of the rear pulleys 1,2, in parallel to the twist so as to press the belts 18, 19 toward the surfaces 20, 21 by a spring force and in a stopped relation with respect to the left and right belts 18, 19.

Figure 3:
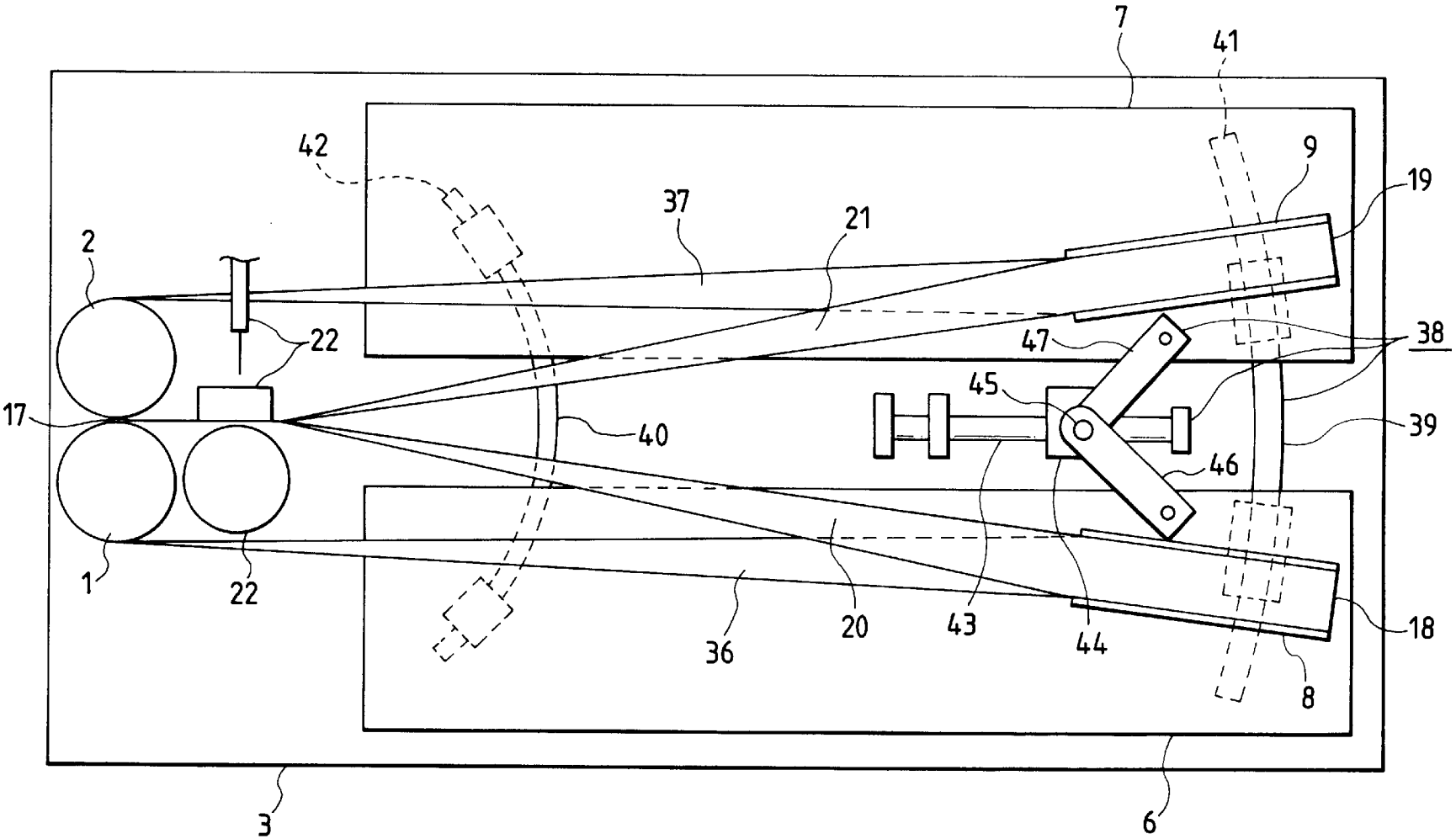
FIG. 3 is a plan view showing an arrangement of left and right belts.
Figure 5:
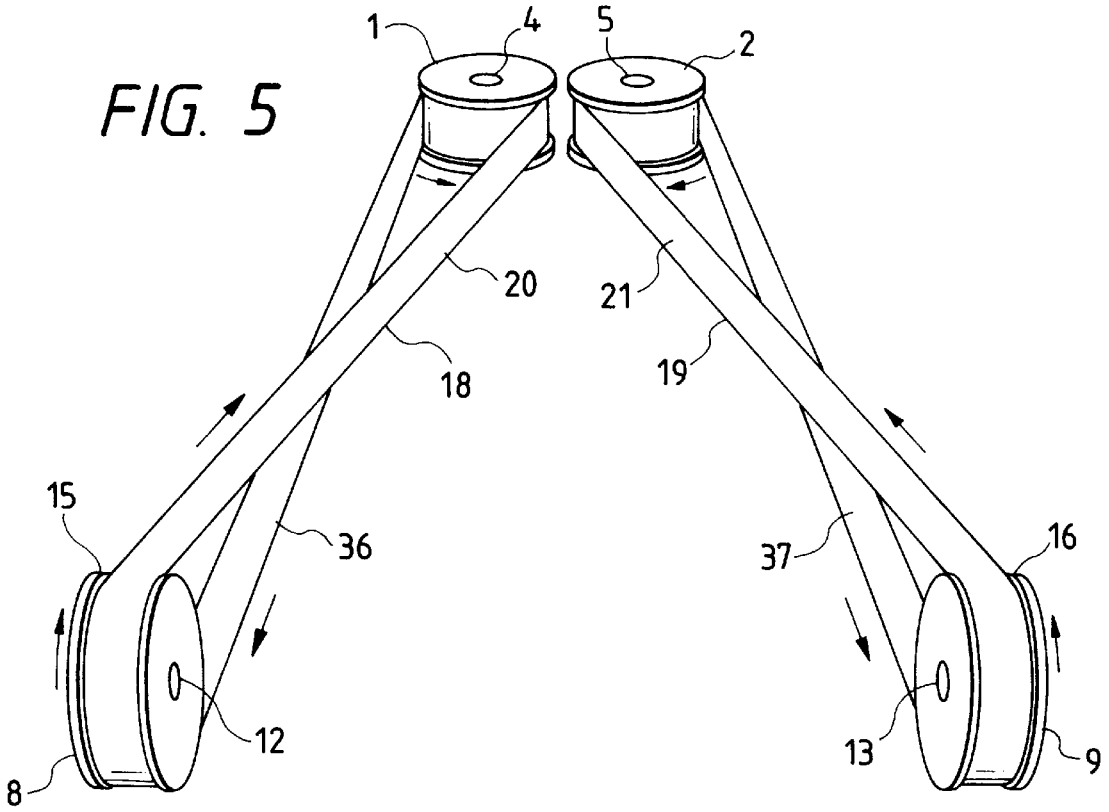
FIG. 5 is a perspective view showing the arrangement of the left and right belts as seen from diagonally above of the front side.
Figure 7:
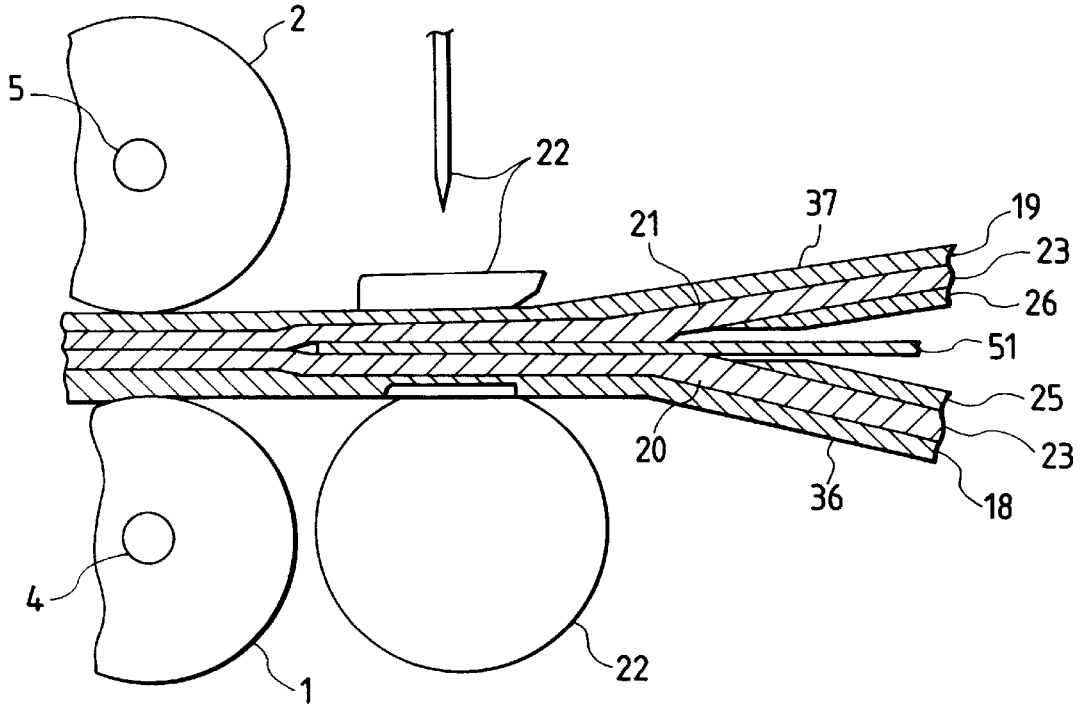
FIG. 7 is a side view in vertical section of a spacer and a sewing device.

A first angle adjusting assembly 38 shown in FIGS. 2 and 3 is adapted to make an angle formed by the distance between the left and right pulleys 8,9 with respect to the adjacent parts 17 of the outer peripheries of the left and right rear pulleys 1,2 increase or decrease toward both sides of a straight line extending between a center of the distance and the adjacent parts 17 symmetrically or unsymmetrically. The assembly comprises upwardly projecting arcuate ribs 39, 40 provided on an upper face of the main frame 3 in its forward and backward areas around the adjacent parts 17 or a laterally displaced point as the center of the arc, arcuate grooves 41, 42 formed on lower faces of the movable plates 6, 7 in its forward and backward areas and adapted to engage with the arcuate ribs 39, 40 and a screw bolt 43 rotatably supported on the upper face of the main frame 3 along the straight line so that it can rotate around the straight line manually or by means of an automatic outer force but not move along the straight line, a nut 44 longitudinally movably engaged with the screw bolt 43, a stud 45 vertically fixed to the nut 44, and a pair of left and right links 46, 47 rotatably connected to the stud 45 and to the movable plates 6,7.

Figure 6:
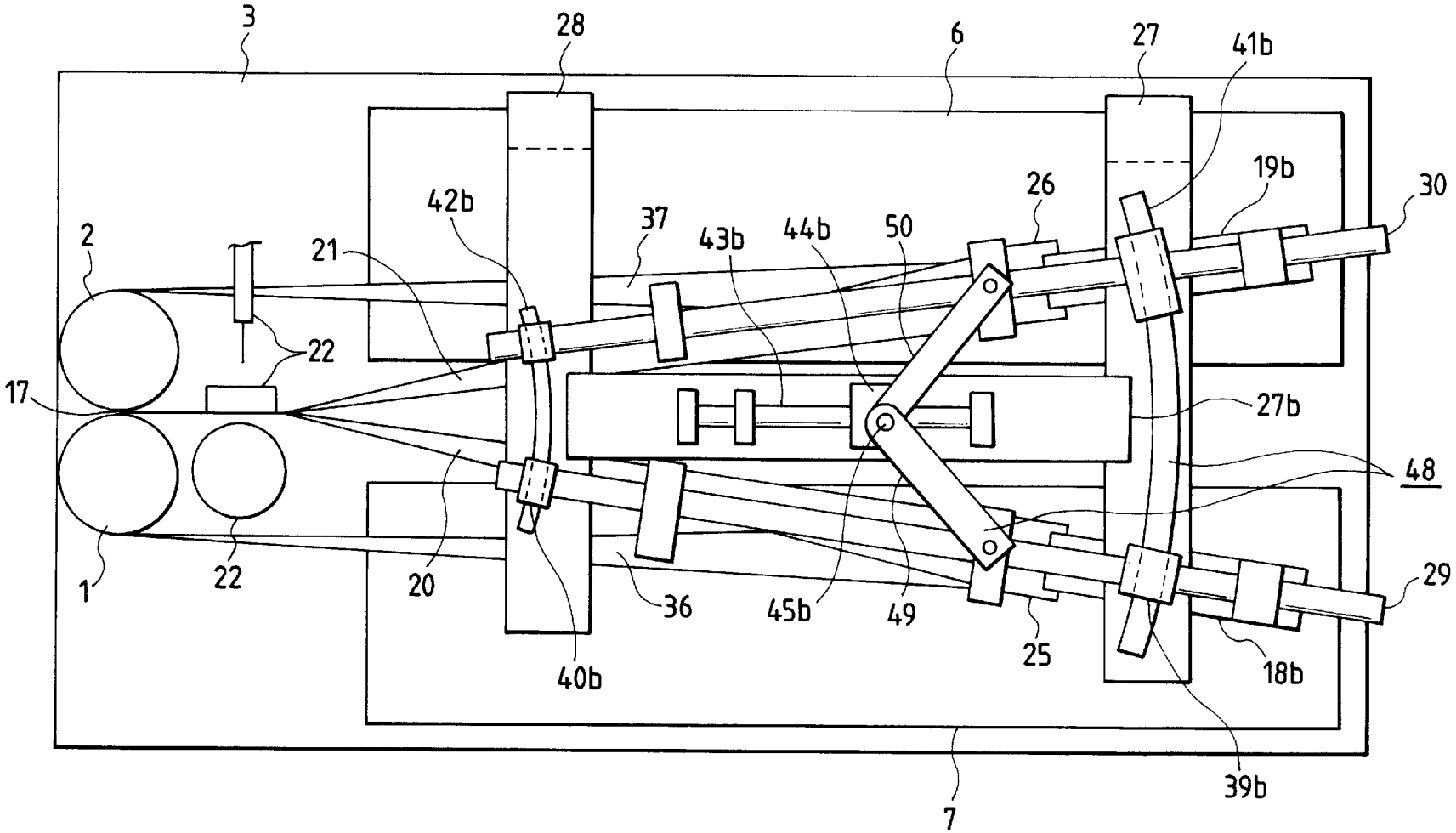
FIG. 6 is a plan view showing an arrangement of guide members.

A second angle adjusting assembly shown in FIGS. 1 and 6 is adapted to make an angle formed by a distance between the left and right guide members 25, 26 and the upper feed member 31, 32 with respect to the adjacent parts 17 of both the outer peripheries of the left and right rear pulleys 1,2 increase or decrease toward both sides of the straight line extending from the center of the distance to the adjacent parts 17 symmetrically or unsymmetrically so as to increase or decrease the angle synchronizing with and at the same angle as the first angle adjusting assembly 38. The assembly comprises arcuate grooves 41*b*, 42*b* provided respectively on upper faces of the forward and backward support frames 27, 28 and having the same arc as the arcuate grooves 41, 42 of the first angle adjusting assembly 38, ribs 39*b*, 40*b* provided on forward and rearward positions of the left and right rods 29, 30 freely engaging therewith and with the arcuate grooves 41*b*, 42*b*, a set of a screw bolt 43*b*, a nut 44*b*, and a stud 45*b* having the same structure as a set of the screw bolt 43, the nut 44 and the stud 45 of the first angle adjusting assembly and movable by means of the same outer driving force, and a pair of lines 49, 50 connected to the stud 45*b* and the rods 29, 30 freely rotatably and engageably therewith.

A spacer 51 (FIG. 7) is supported on a main frame 3 at the intermediate of the pleat 23 formed in the sheet-like material 14 conveyed along the left and right belts 18, 19 when a base portion of the pleat 23 is fixed (for example, by a sewing machine).

Belt receivers 52, 53 (FIG. 4) are supported on the movable plates 6, 7 through the support frames 10, 11 in such a manner that they abut the back faces 36, 37 of the left and right belts 18, 19 near the upper portions 15, 16 of the outer peripheries of the left and right front pulleys 8,9 and extend therefrom in the feeding direction of the left and right belts along their horizontal portions.

Upper and lower members 54, 55 of the upper feed members 31, 32 (FIG. 4) are adapted to move starting portions of the left and right upper belts 18*b*, 19*b* up and down from the surfaces 20, 21 at the starting portions of the left and right belts 18, 19 and comprise left and right air cylinders which are longitudinally movably connected to the rods 29, 30 and links supporting central axes of the front rollers of the left and right rollers 8*b*, 9*b* to which the air cylinders are connected.

Operation of the arrangements . . . the above described components are relatively constructed as follows so as to operate through the following processes:

The air cylinders of the upper and lower members 54, 55 of the left and right upper feed members 31, 32 are moved backward and the front rollers of the left and right rollers 8*b*, 9*b* together with the upper belts 18*b*, 19*b* are slightly raised from the surfaces 20, 21 at the starting portions of the left and right belts 18, 19 to keep a gap therebetween. An end of the sheet-like material 14 in a flat form or folded at one side or both sides thereof into a flat form is introduced into the gap, and then the air cylinder is moved forward to move the starting portions of the upper belts 18*b*, 19*b* downward thereby to press and clamp the sheet-like material 14 onto the surface 20, 21 of the belts 18, 19 (FIG. 4).

The drive means are actuated to make the left and right rear pulleys 1,2 rotate at the same speed in the opposite directions where the adjacent parts 17 of their outer peripheries move apart from the left and right front pulleys 8,9 so that the surfaces 20, 21 of the left and right belts 18, 19 move from the front pulleys 8,9 toward the adjacent parts 17 of the rear pulleys 1,2. Then, the front pulleys 8,9 start to rotate at the same speed with the upper portions 15, 16 of their outer peripheries directed to the both adjacent parts 17.

Figure 4:
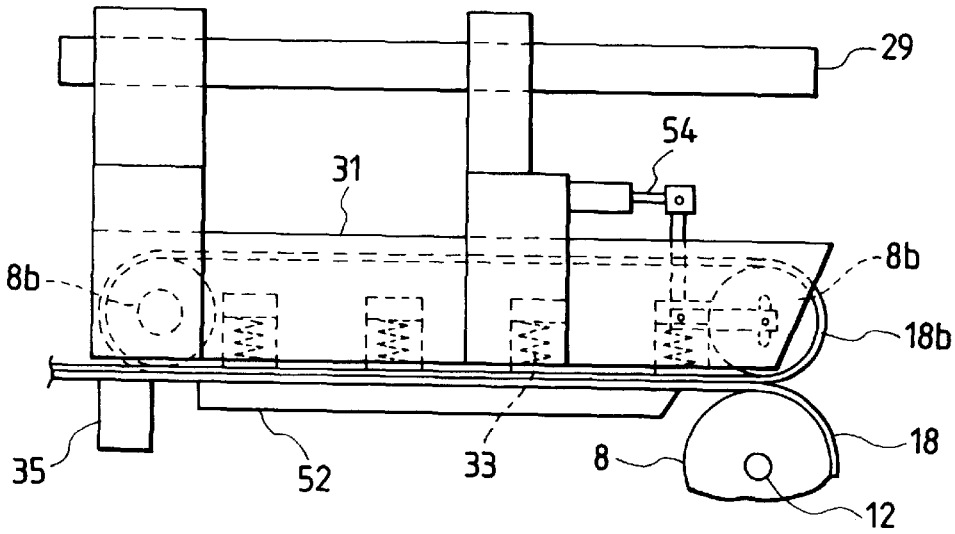
FIG. 4 is a side view of an upper feed member.

The sheet-like material 14 starts to be fed with its one end pressed at both sides thereof downward of the left and right upper belts 18*b*, 19*b* and clamped on the surfaces 20, 21 of the left and right belts 18, 19 horizontally and flatly by means of belt receivers 52, 53 on which the belts 18, 19 are supported (FIG. 4).

Figure 8:
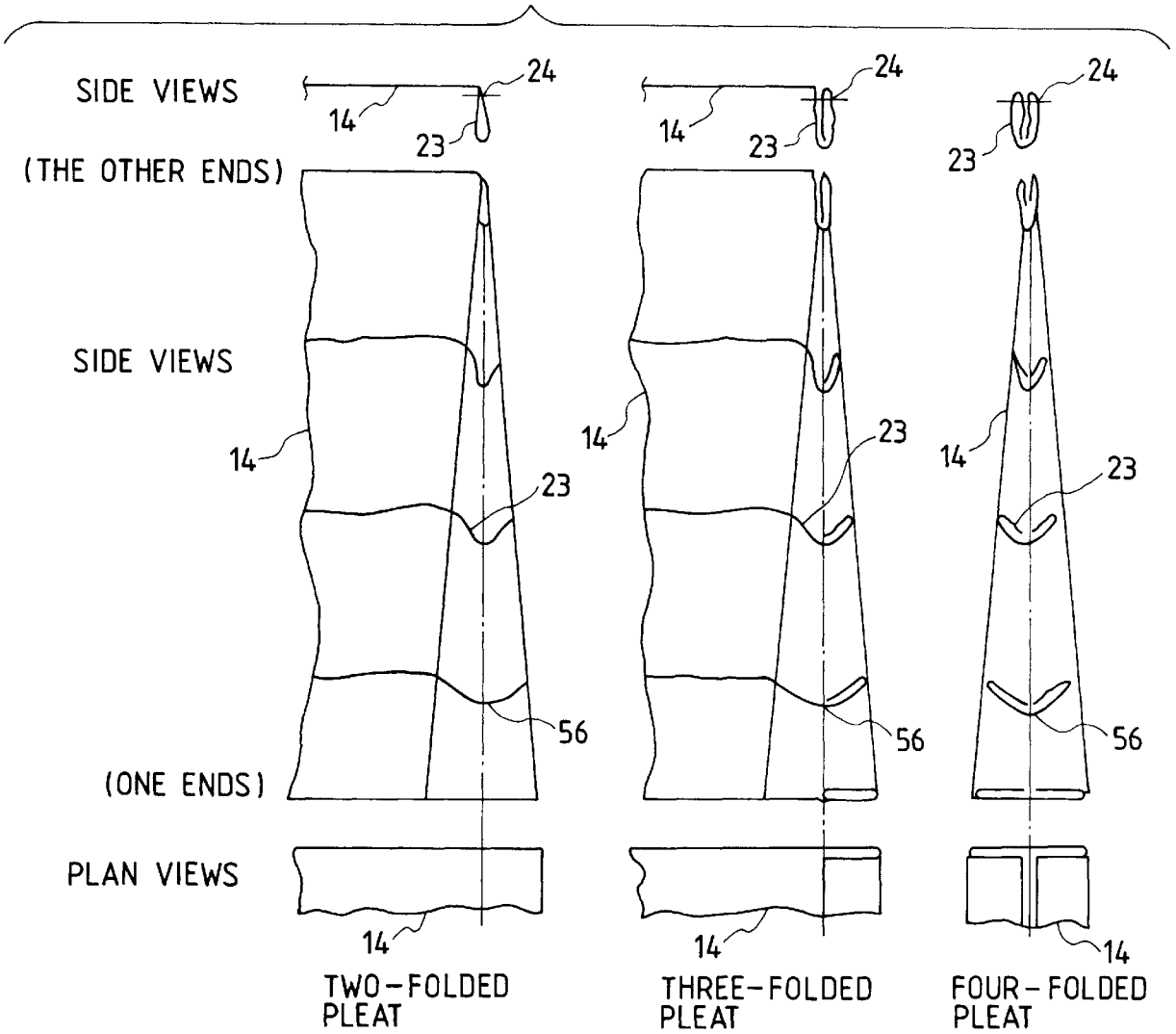
FIG. 8 shows a pleat in a sheet-like material in plan views and side views.

The left and right parts of the one end of the sheet-like material 14 passing under the left and right upper belts 18*b*, 19*b* are guided by the twist of the surfaces 20, 21 of the left and right belts 18, 19 and guided by means of the guide members 25, 26 to be clamped to the guide members by the spring force of the pressure members 34, 35, whereby both the left and right parts of the sheet-like material 14 are drawn near gradually reducing the distance therebetween toward the center and come into contact with each other, and gradually suspended diagonally with respect to the surface, thus forming a recess 56 (FIG. 8).

The left and right parts of the one end of the sheet-like material 14 continuously conveyed pass by the spacer 51 and are closely fitted to each other sandwiching the spacer 51. They face with each other perpendicularly to the surface and then completely suspended, thus forming the pleat 23 (FIG. 8).

The pleat 23 of the sheet-like material 14 further conveyed through the spacer 51 is fixed at its base portion 24 by means of the working device 22 such as a sewing machine, just before the adjacent parts 17 of the outer peripheries of the left and right rear pulleys 1,2, and then drawn out of the adjacent parts 17 as shown in FIGS. 3, 6 and 8.

As for the drive means, the front and rear left and right pulleys may be positively rotated by means of independent drive means respectively or may be followingly rotated by single common drive means. They may be rotated intermittently or continuously corresponding to function of the sewing machine as the working device 22.

The left and right belts 18, 19 may be made of a needle cloth provided on its surface with a plurality of needles piercing through the sheet-like material 14 such as a thin cloth, thus eliminating the guide members, upper feed members and pressure members.

In place of the spring force of the upper feed members 31, 32 and the pressure members 34, 35, there may be employed solenoids of various kinds of fluids.

In place of the first and second angle adjusting assemblies 38, 48, there may be employed plate-like guides by means of which the lateral distances between the respective structural elements are fixed so as to vary a depth with which the surface of the sheet-like material 14 is pressed downward while conveyed.

The relative arrangement of the components may be altered so that the components at the side where the sheet-like material 14 is introduced are made vertical or diagonal, while those at the side where the pleat is fixed by sewing are made horizontal.

The working device may include a lock-stitch sewing machine, a chain-stitch sewing machine, a blind-stitch sewing machine, a binding machine, or a fusion welding machine.

With the structure and operation as described above, the invention can overcome the defects in the conventional manual feeding arising from the differences in the various conditions and unstable feeding of the fabrics, owing to the automatic feeding and twisted feeding of the fabric in this invention. Thus, the following remarkable effects can be attained.

Because the folding width of the pleat is automatically made variable by means of the angle adjusting assemblies, and the fabric is gradually conveyed twistingly by means of the automatic feeding of the belts, the folding width of the pleat can be easily modified and adjusted. Thus, the pleat can be made symmetrically without the lateral deflection, and the drops of the seams from the fabric can be eliminated thereby forming the pleats of high accuracy.

Because the fabric is conveyed with a gradual twist, the pleat can be accurately folded and fixed by sewing regardless of the width of the pleat, the stable pleats can be formed in even a long-sized fabric as well as in a short-sized fabric.

Since the upper feed members and pressure members resilinetly press the fabric to the belts, the fabric overlapped with another fabric on either of the both sides thereof or the fabric different in thickness at both sides because of a seam can be introduced and conveyed without any problem.

When the base of the pleat is fixed by the sewing machine, the spacer 51 is interposed between the left and right parts of the fabric of the pleat, tensile sewing force of the stitches by the machine will be relaxed, thereby eliminating wrinkles formed in the fabric.

Moreover, a two-folded pleat will be made in case where a fabric on the left hand of a straight line corresponding to a center line of the distance between the left and right belts has not been previously folded. In case where the fabric has been previously folded there, a three-folded pleat can be made. In case where the fabric has been previously folded on both left and right hands of the center line, a four-folded pleat can be made.

What is claimed is:

1. An apparatus for making a pleat in a sheet material comprising:

a main frame having a surface;

a left vertical shaft and a right vertical shaft disposed on said main frame so as to be parallel to one another;

a pair of left and right rear pulleys rotatably supported by said left and right vertical shafts respectively wherein said left and right rear pulleys include outer peripheries that face each other and are disposed on opposite sides of a vertical plane;

left and right movable plates supported on said main frame so as to be separately movable to the left and the right along the surface of said main frame;

a left horizontal shaft and a right horizontal shaft disposed on said left and right movable plates respectively, wherein said left and right horizontal shafts are spaced apart from the left and right vertical shafts in a radial direction;

left and right front pulleys which are rotatably supported by said left and right horizontal shafts respectively, said left and right front pulleys including outer peripheries having upper portions on which the sheet material is to be placed and fed wherein said left and right front pulleys rotate in a direction which causes each of velocity vectors at the upper portions to converge in a direction toward said vertical shafts;

drive means which is adapted to control said left and right rear pulleys so that they rotate at a same speed as one another, but in opposite directions, and is adapted to control said left and right front pulleys so that they rotate at the same speed as one another and at the same speed as said left and right rear pulleys, wherein the outer peripheries of said left and right rear pulleys are spaced apart from the outer peripheries of said left and right front pulleys, respectively;

a left belt which is wound around said left front pulley and said left rear pulleys in such a manner that a first surfaces of the left belt is gradually twisted from horizontal to vertical;

a right belt which is wound around said right front pulley and said right rear pulley in such a manner that a first surface of the right belt is gradually twisted from horizontal to vertical, wherein the right and left belts are disposed so that said first surfaces gradually face each other while moving from the upper parts of the outer peripheries of the front pulleys toward facing parts of the left and right rear pulleys whereby when the sheet material is fed by said first surfaces, a pleat is formed in the sheet material, and sewing means for sewing the pleat which is formed in the sheet material as it is conveyed by the first surfaces of the left and right belts, said sewing means including a clamp supported on said main frame near the facing parts of the outer peripheries of the rear pulleys so as to hold the pleat.

2. An apparatus for making the pleat in the sheet material as claimed in claim 1, which comprises left and right guide members formed by thin plates and fixed on said main frame so as to move laterally and contact both said first surfaces of the left and right belts from the upper parts of the outer peripheries of said left and right front pulleys to the facing parts of said left and right rear pulleys in parallel to said twist of the left and right belts, respectively.

3. An apparatus for making the pleat in a sheet material as claimed in claim 1, which comprises left and right upper feed members rotatably and laterally movably supported on said main frame so as to convey the sheet material at the same speed and in the same direction as the left and right belts, while both said left and right parts of the sheet material are pressed toward the surfaces of the left and right belts near the upper parts of the outer peripheries of the left and right front pulleys.

4. An apparatus for making the pleat in the sheet material as claimed in claim 1, which comprises a first angle adjusting assembly provided between said main frame and said movable plates so as to make an angle formed by a distance between said left and right front pulleys with respect to said facing parts of the outer peripheries of said left and right rear pulleys increase or decrease toward both sides from a straight line extending between a center of said distance and said facing parts symmetrically or unsymmetrically.

5. An apparatus for making the pleat in the sheet material as claimed in claim 2, which comprises a plurality of left and right pressure members supported by means of the left and right movable plates and adapted to contact both back surfaces of the left and right belts respectively from the upper parts of the outer peripheries of said left and right front pulleys to the facing parts of said left and right rear pulleys with being in parallel to said twist of the left and right belts, respectively, so as to press the belts toward front surfaces directions thereof.

6. An apparatus for making the pleat in a sheet material as claimed in claim 4, which comprises a second angle adjusting assembly interposed between said main frame and said left and right guide members or between said left and right guide members and said left and right upper feed members so as to synchronize with the increase or decrease of the angle by said first angle adjusting assembly with the same angle thereof.

7. An apparatus for making the pleat in the sheet material as claimed in claim 1 wherein said sewing means further includes a spacer in a form of a thin plate to be placed at an intermediate portion of the pleat.

* * * * *